US006065419A

United States Patent [19]

Stecker, Sr.

[11] Patent Number: 6,065,419

[45] Date of Patent: May 23, 2000

[54] UNDERWATER DIVE VEHICLE

[75] Inventor: David W. Stecker, Sr., 23 W. 540 Bryn Mawr, Roselle, Ill. 60172

[73] Assignee: David W. Stecker, Sr., Roselle, Ill.

[21] Appl. No.: 09/086,282

[22] Filed: May 28, 1998

[51] Int. Cl.[7] ..... B63C 11/46

[52] U.S. Cl. ..... 114/315; 114/333; 114/338

[58] Field of Search ..... 114/315, 333, 114/125, 121, 331, 337, 338; 440/6; 310/87

[56] References Cited

U.S. PATENT DOCUMENTS

| | | | |
|---|---|---|---|
| 2,722,021 | 11/1955 | Keogh-Dwyer | 114/315 |
| 3,135,884 | 6/1964 | Luenberger | 310/87 |
| 3,584,594 | 6/1971 | Poutout . | |
| 3,650,234 | 3/1972 | Goudy . | |
| 3,685,480 | 8/1972 | Peroni . | |
| 3,751,030 | 8/1973 | Winters | 114/121 |
| 3,916,814 | 11/1975 | Bardoni et al. . | |
| 3,954,081 | 5/1976 | Blake | 440/6 |
| 4,864,959 | 9/1989 | Takamizawa et al. . | |
| 4,996,938 | 3/1991 | Cameron et al. . | |
| 5,379,714 | 1/1995 | Lewis et al. . | |
| 5,634,423 | 6/1997 | Lashman . | |

OTHER PUBLICATIONS

Chapter 3, *Encyclopedia of Recreational Diving—2nd Edition*. Padi Organization, 1996.

*Primary Examiner*—Sherman Basinger
*Attorney, Agent, or Firm*—Lee, Mann, Smith, McWilliams, Sweeney & Ohlson

[57] ABSTRACT

The underwater dive vehicle disclosed has a selectively energizable propulsion unit for forcible driving the vehicle through the water and at least one resilient gas filled buoyancy element which is in open contact with the surrounding water when the vehicle is in the water. The volume of the gas in the buoyancy element provides sufficient displacement of the water to keep the vehicle afloat at the surface when unattended or to support a diver. When the vehicle is submerged water pressure will act directly upon and tend to compress the resilient buoyancy element and the gas contained therein. This reduces the volume of the gas within the buoyancy element and thus reduces buoyancy of that element. Sealed housings such as those surrounding parts of the propulsion unit are filled with a non-conductive and non-corrosive liquid to prevent distortion and subsequent leaking of the seals, and non-moveable electrical components are encased in waterproof epoxy.

9 Claims, 3 Drawing Sheets

UNDERWATER DIVE VEHICLE

BACKGROUND OF THE INVENTION

This invention relates to an underwater dive vehicle of the type which may be used for propelling divers to underwater locations, and more particularly to a powered underwater dive vehicle in which the buoyancy may be reduced as the vehicle descends to greater depths in the water, and in which water leakage into sealed compartments of the vehicle is minimized or eliminated.

Small powered underwater dive vehicles for taking one or two divers to underwater locations usually comprise a motor having a drive shaft which is operably connected to a propeller, a battery for energizing the motor and a control switch for selectively energizing the motor. Such devices are illustrated and described, for example, in U.S. Pat. Nos. 5,379,714, 4,864,959 and 4,996,938. Such vehicles, however, have encountered problems of buoyancy and leakage. Leakage is a particular problem when the vehicle is taken to substantial depths where the pressure maybe several atmospheres. For every 10 meters of descent in sea water, an additional atmosphere of pressure is placed on the vehicle and its parts. Thus, at a depth of 30 meters or approximately 100 feet, there are 3 atmospheres of pressure, and the pressure corresponding increases as greater depths are attained. Underwater dive vehicles should be designed to withstand 15 atmospheres of pressure or the pressure that would be encountered at a depth of 500 feet.

The greater the pressure, the more stress there is on the seals which are in place to keep water out of such areas as the buoyancy chambers, the housings surrounding the batteries and the motor. U.S. Pat. No. 4,864,959 recognizes this problem and is directed to detecting leaks of sea water into the battery or motor compartments of underwater dive vehicles. That patent also suggests that water absorbing sheets be stuffed around mechanical parts and the battery and clutch compartments. Another moisture detection system for an underwater dive vehicle is disclosed in U.S. Pat. No. 4,996,938.

Another problem with underwater dive vehicles has to do with the buoyancy of the vehicle. It is highly desirable that at the surface the vehicle have a positive buoyancy so that the unattended vehicle may float on the surface and preferably also support a diver at the surface. However, during the dive, the operator of the vehicle should not be constantly fighting buoyancy.

It is thus an object of the present invention to provide a solution to the water leaks which have heretofore plagued underwater dive vehicles by so constructing the vehicle that the water tight seals are not placed under stress even when the vehicle submerges to depths of several hundred feet.

It is another object of this invention to provide an underwater vehicle the frame of which is open to the water and which thus eliminates any pressure on the frame.

It is a further object of this invention to provide an underwater dive vehicle that has a positive buoyancy at the water surface but which buoyancy may be automatically reduced as the vehicle is taken to greater depths.

It is an additional object of this invention to provide an underwater dive vehicle that has an easily adjustable buoyancy which will permit the vehicle selectively to float at the surface of the water, to reduce its buoyancy as the vehicle is descending in the water, to remain at a neutral buoyancy at any selected depth, and to reduce or increase the buoyancy at any time during the dive.

SUMMARY OF THE INVENTION

The underwater dive vehicle constructed in accordance with this invention comprises a selectively energizable propulsion unit for forcibly driving said vehicle through the water, and buoyancy means including at least one resilient gas filled buoyancy element preferably disposed within a buoyancy chamber. There may be one or more buoyancy chambers, each containing one or more buoyancy elements. Each buoyancy chamber is open and thus the buoyancy element is exposed to and is in contact with the surrounding water when said vehicle is in the water, and the volume of gas in said buoyancy element provides sufficient displacement of the water to keep the unattended vehicle afloat at the surface. Since the buoyancy element is exposed and thus in direct contact with the water, when said vehicle is forced downwardly in the water by the propulsion unit the increasing water pressure will act upon and compress the buoyancy element and the gas contained therein reducing the volume of the gas and thus automatically reducing the buoyancy of the buoyancy element. The buoyancy element may be a very resilient bladder of rubber or Neoprene which may be conveniently filled with any gas such as air. In the alternative the buoyancy element may be constructed of a foamed, resilient plastic material, such as foamed neoprene, which has discrete isolated pockets or closed cells of entrapped air.

In one form of the invention the vehicle has a central frame, which is preferably hollow, and the buoyancy means includes a pair of hollow outriggers, open preferably at one or both ends and having arms connected to the central frame of the vehicle. This connection may be fixed or it may be a pivotal connection permitting the outriggers to be pivotally swung between an inwardly folded position overlying the vehicle central frame and an outwardly extended position laterally outward from the frame on opposite sides thereof. If the connection is a pivotal connection means is provided for locking the outriggers in their desired position relative to the frame. A buoyancy element, in the form of either a resilient bladder or resilient foamed closed cell plastic is mounted within each of the outriggers and preferably also within the central frame.

If the buoyancy element is in the form of a resilient bladder, it is preferred that there be a buoyancy control device in fluid communication with the bladder. This device includes a source of gas under pressure for inflating the bladder and a manually operable valve for deflating the bladder. The buoyancy control device permits the vehicle operator to adjust the volume of air or other gas within the bladder to accommodate changes in volume due to compression from the surrounding water as the vehicle descends and ascends in the water.

In the preferred embodiment the propulsion unit includes an electric motor having an output shaft on which is mounted a propeller. An electric storage battery supplies the electric current for driving the motor, and a manually operable switch, which may be in the form of a push-button or joystick, permits the motor to be selectively energized by the diver-operator. While not preferred, a jet propulsion unit could be employed.

It is preferred that all electrical terminals, such as the terminals for the battery and the motor be encased in a waterproof epoxy resin, so that the sea water will not come into contact with these terminals and cause corrosion.

The invention also features means for preventing water from entering sealed cavities of the vehicle. This is accomplished by filling those cavities with a non conductive and noncorrosive liquid, such as transformer oil. Since liquids are substantially non-compressible, seals which are positioned to prevent the entry of sea water into the cavities of the vehicle will be supported by the liquid in the interior of the cavity and will not be distorted by the pressure of the sea water acting through the seal against a compressible and thus non-supporting gas within the cavity. In other words, with liquid in the interior of the cavity, the seal will not be moved inwardly in a manner which would otherwise cause it to distort or stress and permit leakage of sea water into the cavity.

DETAILED DESCRIPTION OF THE PREFERRED EMBODIMENTS

Figure 1:
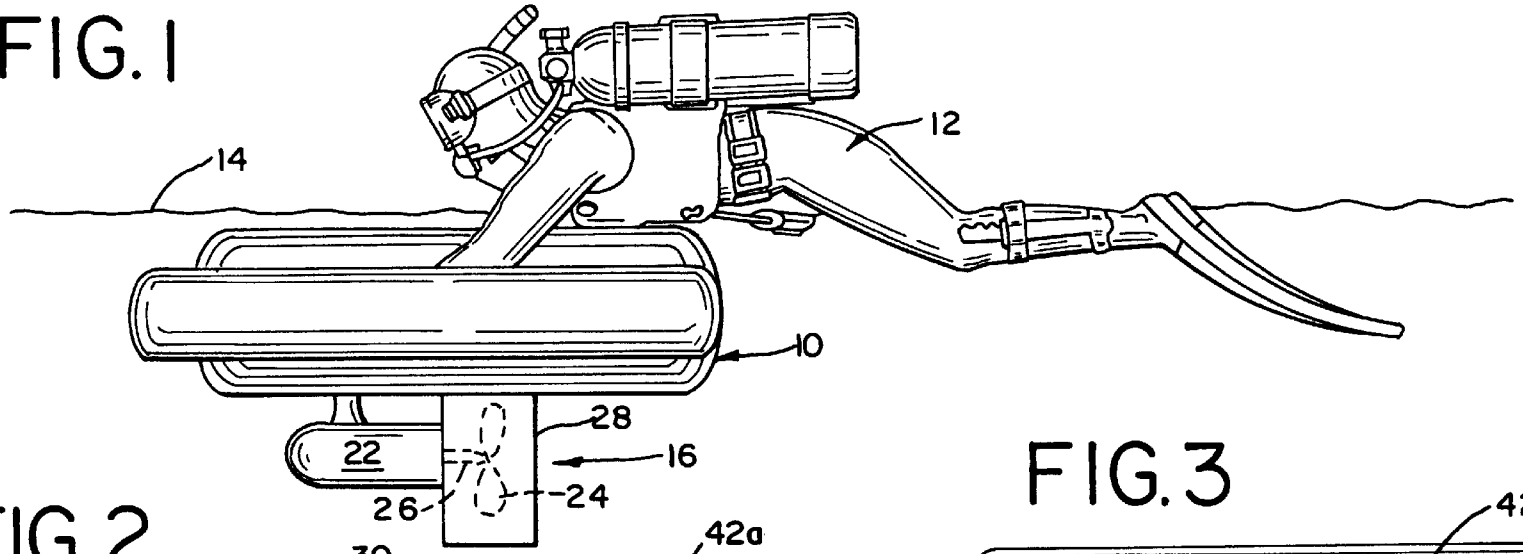
FIG. 1 is a side elevational view of an underwater dive vehicle constructed in accordance with one embodiment of the invention, showing a diver on the vehicle at the surface of the water.

In FIG. 1 there is illustrated an underwater dive vehicle 10 constructed in accordance with this invention. The dive vehicle is being used by a diver 12 and in this figure it is illustrated at the surface of the water 14. Although described as a dive vehicle, it will be appreciated that the vehicle may also be used on the water surface to transport a diver to a dive location.

Figure 2:
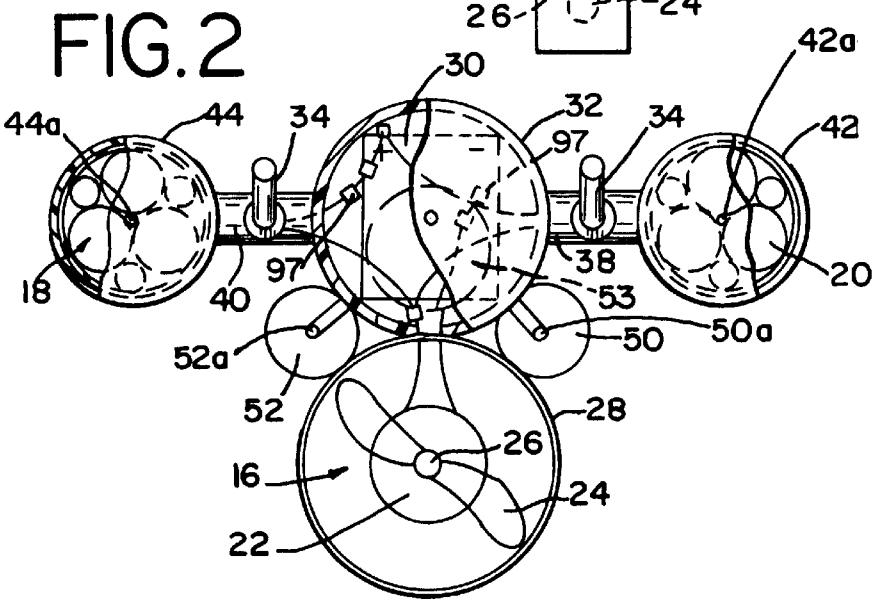
FIG. 2 is an end elevational view of the vehicle with portions of the buoyancy chambers and propulsion unit and battery compartments cut away to show the interiors thereof.

As best illustrated in FIG. 2, the dive vehicle comprises a selectively energizable propulsion unit 16 for forcibly driving the vehicle through the water. The vehicle also includes bouyancy means in the form of at least one and preferably two outwardly disposed gas filled bouyancy elements 18 and 20.

The selectively energizable propulsion unit preferably includes a motor 22 which drives a propellor 24 through a suitable and well-known connections such as a drive shaft 26. A standard battery driven trolling motor is quite satisfactory. A suitable protection cage 28 surrounds the propeller 24. A suitable sealed nickel-cadmium, dry cell or gel cell lead acid battery 30 housed within a central body or housing 32 provides the electrical energy for the motor 22 of the propulsion unit 16. The battery 30 is selectively electrically connected to the propulsion unit 16 by means of suitable switches 34 which may be in the form of joysticks of the kind commonly used to operate underwater vehicles of this type. These switches may also be of other types such as for example, push button switches, but they should be capable of easy manipulation by the diver. The switches, indeed, may actually operate solenoids which close the circuit between the battery 30 and the propulsion unit if this is desired in order to minimize the electrical energy passing through these switches 34 and 36. If desired, only one switch may be employed, the other serving as a grip or a switch for operating a buoyancy control device which will be more fully hereinafter explained. If desired, a suitable well-known jet propulsion unit may be employed instead of the propeller diver propulsion unit.

Figure 3:
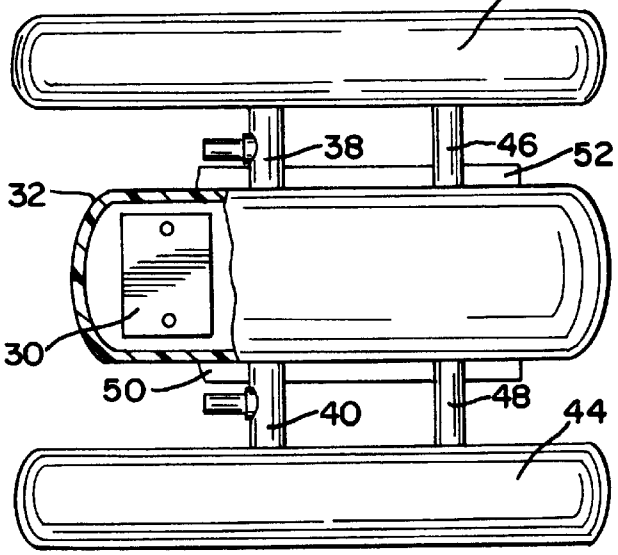
FIG. 3 is a top plan view of the vehicle with a portion of the battery compartment cut away to show the interior thereof.

In the vehicle illustrated in FIGS. 1, 2 and 3, the motor 22 of the propulsion unit 16 is mounted below the tubular central housing 32 and the drive shaft 26 extends rearwardly to operate the propeller 24. The switches 34 and 36 are mounted on hollow, tubular connecting arms 38 and 40 which connect the central housing 32 to outwardly disposed bouyancy element housings 42 and 44 on either side of the central housing 32, and a similar pair of rearwardly disposed connecting arms 46 and 48 also connect the rearward portion of the central housing 32 to the rearward portion of the bouyancy element housings 42 and 44 on either side thereof, as best shown in FIG. 3.

One feature of the vehicle is the construction of the bouyancy elements 18 and 20 within the bouyancy element housings 42 and 44. Each of the bouyancy element housings is open preferably at both ends so that the water may enter the housing and contact the buoyancy elements when the vehicle is in the water. The bouyancy elements 18 and 20 consist of elements which are substantially filled with air or other gas and which are highly resilient and flexible. Each bouyancy element may, for example, be a rubber or neoprene bladder which is filled with air, or it may be a very resilient and compressible closed cell foamed material such as foamed polyurethane, polyethylene, silicon sponge rubber, PVC, neoprene sponge rubber or the like. The material should be very resilient and compressible. Compressibility at between about 2.5 psi and 14 psi of 25% deflection is satisfactory. The density should be as low as possible. Alternatively, the buoyancy elements may be a combination of closed cell sponge material and inflatable bladders.

In FIG. 2 the forward openings 42*a* and 44*a* are provided in the bouyancy element housings 42 and 44 respectively. Similar openings are provided in the rear of these housings with the openings being such that the water may freely enter the housings 42 and 44. Preferably, the openings should just be large enough to assure the entry of water into the housings and to permit draining. Thus, the bouyancy elements 18 and 20 are always subject to the pressure of the water at the depth at which the vehicle is being operated. In the case of a closed cell sponge such as neoprene sponge rubber, gases are entrapped in the discrete closed voids and when the vehicle is submerged, the bouyancy element will be subject to the pressure of the water which will tend to compress the entrapped gas in the buoyancy element, with the pressure increasing as the depth increases. When the vehicle is brought to the surface the water may be easily drained from the bouyancy element housings 42 and 44 through the forward openings 42*a* and 44*a* or the rearward openings (not shown).

The invention contemplates an adjustment of buoyancy, if desired. For such adjustment, in each of the bouyancy element housings, there should be at least one inflatable bladder which may alone serve as the bouyancy element or the buoyancy element may be several bladders or a combination of bladder and closed cell sponge material. It is preferred that there be a bouyancy control device of the type commonly used by divers in connection with underwater neoprene wet suits. For this purpose, as shown in FIGS. 2 and 3, there are provided two pressurized air tanks 50 and 52 which are connected through suitable tubing and valving 50*a* and 52*a* to bouyancy element bladders 18 and 20 within the bouyancy element housings 42 and 44. This permits the diver to adjust the bouyancy of the bouyancy elements 18 and 20 within the bouyancy element housings 42 and 44. This may be desirable if, for example, there is excessive weight on the vehicle such as when two divers are using the vehicle or heavy objects are being carried by the diver.

At the surface of the water the bouyancy elements 18 and 20, consisting of the bladder or foamed material or combination of bladder and foamed material, will contain sufficient entrapped air so that the vehicle will remain on the surface or at the surface even if the vehicle were unattended. However, as the vehicle is driven to greater depths, the gas in the bouyancy elements 18 and 20 will compress and ultimately the unit will become negatively buoyant because the air in these elements will be compressed and the bouyancy elements will become very small. At this point the diver could further inflate the bouyancy elements from the air tanks 50 and 52, thus increasing the bouyancy and permitting the vehicle to remain at the desired depth even when the motor is not running.

The valving 50*a* and 52*a* is such that during the ascent of the vehicle to the surface, the air may be released from, and the pressure reduced in, the bouyancy element bladders 18 and 20. The valving 50*a* and 52*a* may be in the nature of conventional check valves which automatically release the pressure in the bladders so that the bladders do not burst from excessive internal pressure when the vehicle is brought to the surface. If desired, the valves for inflating and deflating the bouyancy element bladders 18 and 20 may be controlled by well known valve-operating buttons on one or both of the control switches 32 and 34, or in the alternative, the pressurizing and relieving of pressure from the bladders may be done automatically through the valving 50*a* and 52*a* with the control being such that there will always be a neutral or slight bouyancy for the vehicle.

It may be desirable to adjust the valving 50*a* and 52*a* such that the differential between the internal air pressure and the external water pressure is constant. For this purpose simple and conventional ball check valves may be employed capable of releasing air if there is a predetermined difference in pressure between the inside and outside of the bladder and valve. Thus, as the vehicle descends to greater depths and the water pressure increases, the bouyancy control device through the valving 50*a* and 52*a* will sense the increasing pressure outside the bladder and valve and manually or automatically supply additional air under pressure from the air tanks 50 and 52 to increase the internal pressure in the bladder to keep the bladder inflated and the differential constant. When the vehicle ascends and the water pressure decreases, the valving will sense this decrease and will, preferably automatically, release the air from the inflated bladders so that the size of the bladder will basically remain the same throughout the dive and the ascent and thus the bouyancy provided by the bouyancy elements 18 and 20 will remain constant.

In order to further offset the weight of the vehicle, the motor and the battery, the interior of the central housing 32 which contains the battery 30 may have an additional compressible buoyancy element 53. The central housing has openings to allow the water into the housing to contact the buoyancy element 53 in the same manner as the buoyancy housings 42 and 44.

One other aspect of the invention which is preferred is that all of the wiring including the terminals of the battery be coated with a waterproof epoxy preventing water from contacting the terminals or bare wires, and that all voids be filled with a non-compressible liquid. Thus, even though the interior of the central housing is open to the water, the water will not contact the battery terminals within the central housing.

It is preferred that all housing voids containing moving parts be filled with a non conductive oil such as transformer oil or a silicon grease which is non-compressible at operational depths. This eliminates entrapped air which is compressible. With the housing for the motor 22, for example, filled with a non-compressible non-conductive liquid such as transmission fluid, the seals between sections of the motor housing will have minimum strain placed upon them because the oil or fluid on the interior of the housing is non-compressible and will act internally against the seals to prevent movement. If air was entrapped within the housing this would be extremely compressible, would not resist movement of the seals, and thus would place an enormous strain upon the seals in order to keep the sea water out at operational depths. It is also preferred that all voids even in the wires be filled with the non-conductive non-corrosive liquid to prevent the entry of sea water into those voids.

Figure 4:
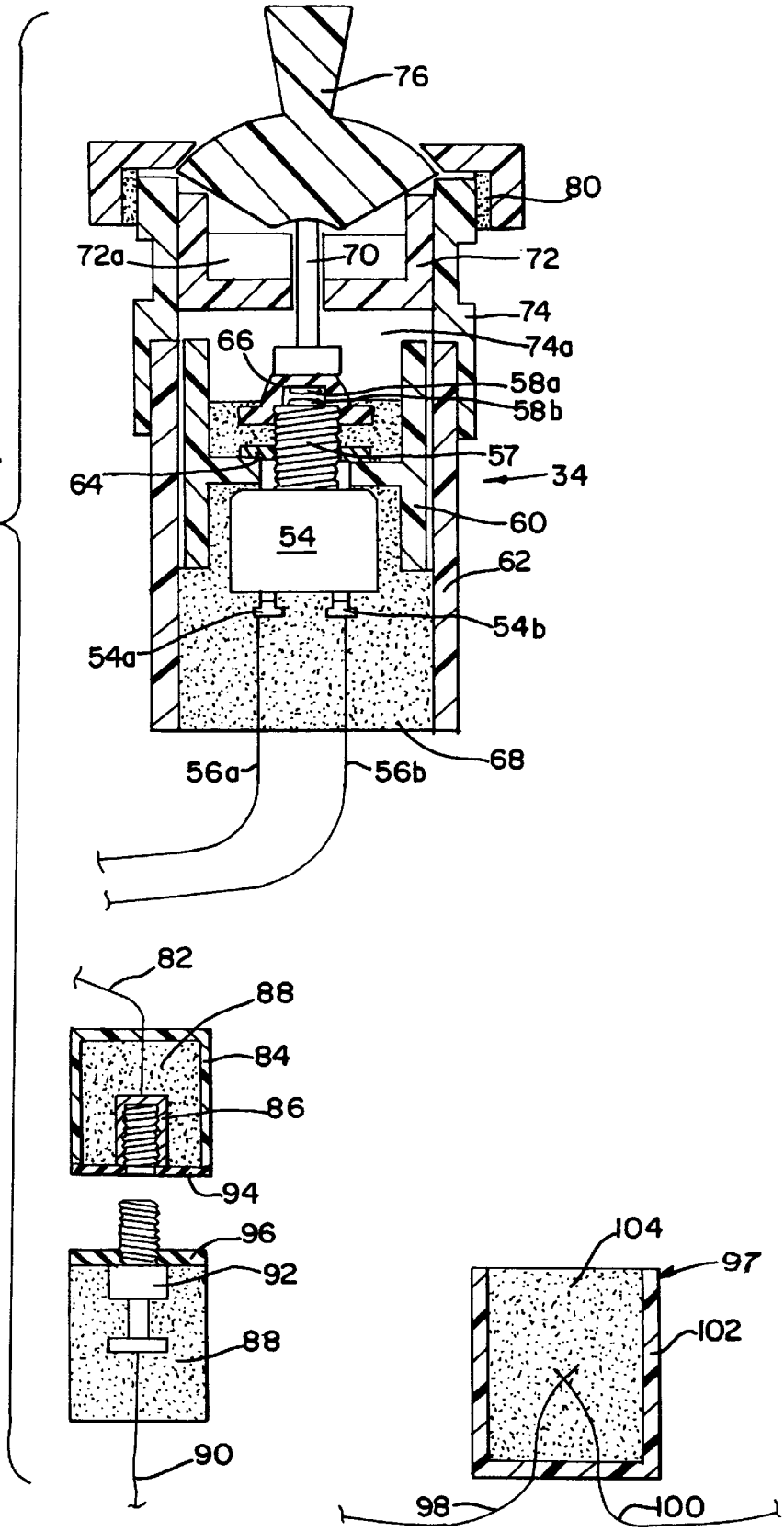
FIG. 4 is an enlarged sectional elevational view of some of the electrical components of the vehicle, namely, the control switch for the motor and two electrical couplings.

An example of this is shown in FIG. 4 in which a typical joystick switch 34 is illustrated. The switch includes a switch assembly 54 having a pair of terminals 54*a* and 54*b* from which wires 56*a* and 56*b* extend. The switch assembly has a threaded upper portion 57 at the top of which is a movable contact 58*a* and a fixed contact 58*b*. The switch assembly 54 is mounted on a PVC switch mounting 60 which is adhesively secured to the outer switch housing 62. The mounting of the switch assembly 54 to the switch mounting is by means of an anchor nut 64 and over the movable and fixed contacts 58*a* and 58*b* of the switch is threaded a flexible neoprene or rubber seal nut 66. The interior of the seal nut 64 surrounding the movable and fixed contacts 58*a*and 58*b* is filled with a silicon grease. The entire switch assembly 54 including the terminals 54*a* and 54*b* and the threaded upper portion 54*c* are encased in a waterproof epoxy 68 which also surrounds the lower portion of the rubber seal nut 66. In contact with the rubber seal nut 64 is a switch activator rod 70 which is slidably mounted in a support 72 glued to the upper switch housing 74, that housing being in turn adhesively secured to the lower switch housing 62. The switch activator rod 70 is operated by the joystick switch operator 76 which is journaled between the upper portion of the support 70 and the cap 78. The interiors 72*a* and 74*a* of the support 72 and of the upper switch housing 74 respectively, are open to water. Due to the presence of the silicon grease when the switch 34 is subjected to high water pressure, the silicon grease will not compress and therefore there is a relatively small strain, if any, on the rubber seal nut 66. However, the pressure exerted by the switch activator rod 70 on the seal nut 66 and the contacts 58*a* and 58*b* under force from the joystick switch operator is sufficient to compress the rubber seal nut 66 and close the contacts 58*a* and 58*b*.

FIG. 4 also shows a connection between two electrical connectors, a wire 82 extends through a connector housing 84 and is electrically connected to an internally threaded brass coupler 86. The housing 84 is filled with a waterproof epoxy 88. A second wire 90 is electrically connected to a second externally threaded coupler 92 and the area surrounding the lower portion of the coupler 92 is encased in epoxy 88. In this instance no housing is shown because it is merely another example of encasing the coupler or electrical connector in epoxy and it is not important that there be a housing surrounding the epoxy. It will be noted, however, that the lower end of the internally threaded brass coupler 86 has a rubber seal 94 and a similar rubber seal 96 surrounds the upper externally threaded portion of the brass coupler 92. Thus, when the two are threadedly engaged, and the seals 94 and 96 are compressed, there will be an electrical connection and there will be a seal with no possibility of sea water contacting the electrical connections of these two couplers. Also shown in FIG. 4 is an epoxy seal 97 for the ends of two electrical wires 98 and 100 which are disposed within a housing 102 which is filled with waterproof epoxy 104. Thus, the ends of the wires 98 and 100 are prevented from contact with the sea water. This type of seal 97 is shown also in FIG. 2. These are examples of the use of waterproof epoxy to prevent water from adversely affecting electrical connections.

Figure 5:
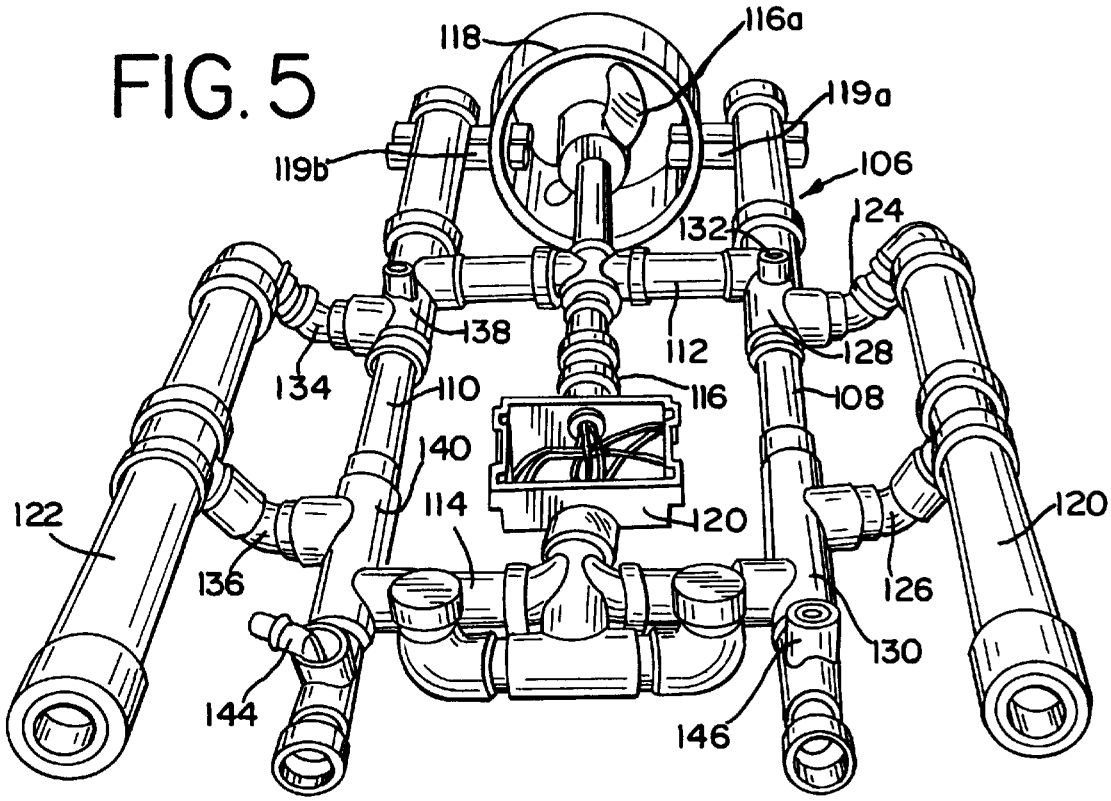
FIG. 5 is a perspective view of an alternative form of the underwater vehicle embodying the teachings of this invention and so constructed that it may be folded for transportation or storage.
Figure 6:
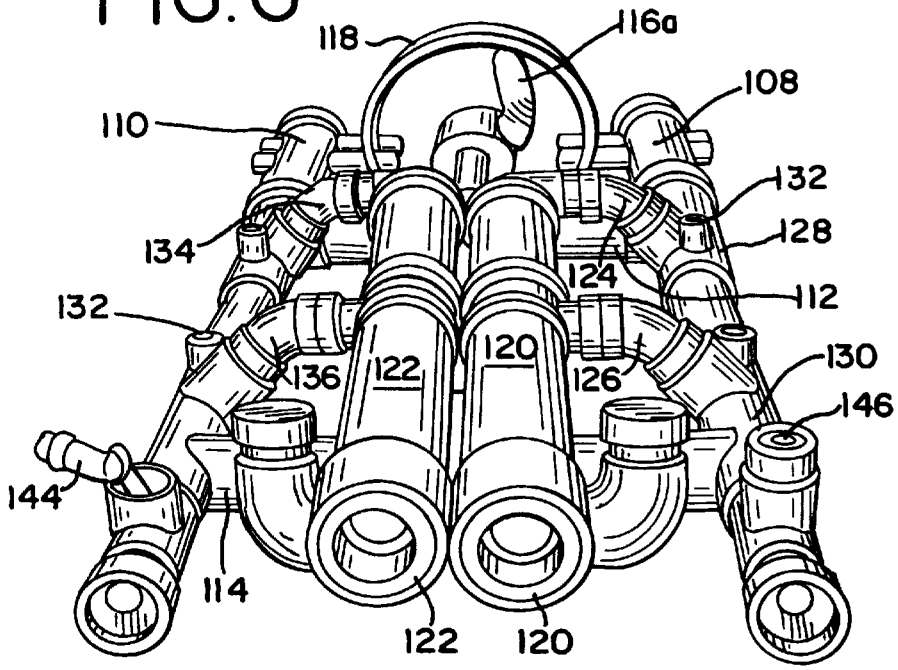
FIG. 6 is a perspective view of the alternative form of vehicle of FIG. 5, showing the buoyancy elements folded inwardly.

In FIGS. 5 and 6 there is shown an alternate form of the underwater vehicle consisting, of a tubular frame 106 including a pair of tubular members 108 and 110 connected by cross arms 112 and 114. All portions of the frame being constructed of hollow PVC tubing and consequently very light. Mounted between the cross arms 114 and 112 is a trolling motor 116 having propeller blades 116*a*. The propeller blades are surrounded by a protection cage 118 suitably connected to the rear portions of the tubular frame members 108 and 110 by braces 119*a* and 119*b*. At the forward end of the trolling motor 116 there is a junction box 120 and a battery (not shown) would be normally mounted on top of this junction box with its wires going into the junction box.

As with the previous embodiment, the terminals for the battery would be covered and the interior of the junction box 120 could be filled with waterproof epoxy, thus preventing sea water from coming into contact with these wires or the terminals. Extending outwardly from the frame 106 are tubular bouyancy element housings 120 and 122. Bouyancy element housing 120 is connected to the tubular frame member 108 by means of connecting arms 124 and 126 affixed to sleeves 128 and 130 which surround the tubular frame member 108 and are movable relative thereto. The buoyancy element housing thus may be swung between an outwardly extended position as shown in FIG. 5 and an inwardly folded position as shown in FIG. 6. Set screw 132 or other suitable locking means may be employed to lock the arms in the desired position. In like manner the bouyancy element housing 122 is connected to the tubular member 110 of the frame 106 by means of a pair of connecting arms 134 and 136 attached to sleeves 138 and 140 respectively. The sleeves 138 and 140 are mounted for rotation on the tubular member 110 and may be moved between an extended position as shown in FIG. 5 to an inwardly folded position as shown in FIG. 6. A set screw or push pin 142 may be used to lock the bouyancy element housing member in its desired position of orientation with respect to the frame.

A suitable motor control switch 144 may be provided on one side of this vehicle which is similar to the joystick 32 of the embodiment of FIGS. 1 through 3 and a separate bouyancy control 146 permits the diver to adjust the bouyancy of the bladder within the bouyancy element housings 120 and 122. As in the previous embodiment the buoyancy element housings 120 and 122 are open at the ends for contact by the surrounding water so that the buoyancy elements therewithin are contacted by the water. If desired, the housings 120 and 122 may be a combination of foamed bouyancy elements and bladders and also the frame 106 may be filled with closed cell foam material of the type previously described. Also, if desired, the buoyancy elements could be on the outside of the frame of the vehicle and thus not within any housing.

It will be readily apparent to those skilled in the art that a number of modifications can be made in the invention without departing from the spirit and scope of the invention which features expandable and contractible bouyancy elements which permit the bouyancy of the underwater vehicle change during the dive. By adjusting the inflation of the bouyancy elements which are open to and subjected to the pressure exerted on the dive vehicle by the water in which the dive vehicle is operating the buoyancy of the vehicle may be selectively or automatically adjusted. The novel way of protecting the interior of the housing and the seals from excessive strain by filling them with a non-compressible fluid and covering all electrical terminals with epoxy are also features of the invention. The vehicle can be made in a wide variety of forms other than those shown and described herein.

What is claimed is:

1. An underwater dive vehicle comprising a selectively energizable propulsion unit for forcibly driving said vehicle through the water, buoyancy means including at least one flexible and resilient gas filled buoyancy element in open contact with the surrounding water when said vehicle is in the water, the buoyancy element being unvalved and completely and permanently sealed against the passage of gas therefrom or water there into, the volume of gas in said buoyancy element providing sufficient displacement of the water to provide the desired amount of buoyancy at the surface, whereby when said vehicle is forced downwardly in the water by said propulsion unit the increasing water pressure will act upon and compress the buoyancy element and the gas contained therein reducing the volume of the gas and thus the buoyancy of the buoyancy element.

2. An underwater dive vehicle comprising a selectively energizable propulsion unit for forcibly driving said vehicle through the water, buoyancy means including a central frame and a pair of outrigger tubes having arms pivotally connected to said central frame whereby said outrigger tubes may be moved between an inwardly folded position overlying said central frame and an outwardly extending position laterally outward from said frame on opposite sides thereof, each of said outrigger tubes containing a resilient gas filled buoyancy element and being at least partially open to permit water to enter and contact said resilient gas filled buoyancy element, whereby when said vehicle is forced downwardly in the water by said propulsion unit the increased water pressure will act upon and compress the buoyancy element and the gas contained therein reducing the volume of the gas and thus the buoyancy of the buoyancy element.

3. An underwater dive vehicle comprising a shell which is normally open to permit water surrounding the vehicle to enter therein, at least one buoyancy element formed of a resilient and compressible foamed plastic having discrete voids in which there is entrapped gas, said buoyancy element being disposed within said shell in direct contact with the water within said shell, the resiliency of said foamed buoyancy element being such that said element and the entrapped gas therein may be substantially compressed as the vehicle submerges, thereby reducing the buoyancy of said buoyancy element as the vehicle submerges and increasing the buoyancy as the vehicle ascends.

4. The underwater dive vehicle of claim 3 and further including a buoyancy element formed of a bladder which is disposed within said normally open shell in direct contact with the water within said shell and selectively inflatable with gas to further increase the buoyancy of the vehicle.

5. An underwater dive vehicle constructed in accordance with claim 3 wherein said vehicle includes a selectively energizable propulsion unit for forcibly driving said vehicle through the water.

6. The underwater dive vehicle of claim 5 wherein the selectively energized propulsion unit includes a motor, a housing for said motor, said housing having seals to prevent water from entering said housing, said housing being filled with a non-conductive liquid which is substantially non-corrosive to the motor and housing and which is substantially non-compressible at pressures present at water depths of several hundred feet, whereby at such depths there will be substantially no distortion of the seals which would cause them to leak.

7. The underwater dive vehicle of claim 5 wherein said selectively energized propulsion unit includes an electric storage battery, a motor having an output shaft, a propeller operatively connected to said motor output shaft, and manually operable switch means for selectively and electrically connecting said battery to said motor to energize said motor and rotate said propeller to drive said vehicle through the water.

8. The underwater dive vehicle of claim 7 wherein said battery, motor and switch means have electrical terminals at least some of which are encased in waterproof epoxy resin.

9. The underwater dive vehicle of claim 5 wherein said selectively energizable propulsion means includes one or more housings with vehicle operating components therein and seals to prevent water from leaking into said housings, said housings being filled with a liquid which is substantially non-corrosive to the vehicle operating components and said housing and which is substantially non-compressible at pressures present at water depths of several hundred feet, whereby at such depths there will be substantially no distortion of the seals which would cause them to leak.

* * * * *